US006684416B1

(12) United States Patent
Chao et al.

(10) Patent No.: US 6,684,416 B1
(45) Date of Patent: Feb. 3, 2004

(54) STRUCTURE OF A SELF-LIFTING TOILET SEAT

(76) Inventors: Yu-Lan Chao, c/o PMB#1008, 1867 Ygnacio Valley Rd., Walnut Creek, CA (US) 94598-3214;Littlee, c/o PMB#1008, 1867 Ygnacio Valley Rd., Walnut Creek, CA (US) 94598-3214

( * ) Notice: Subject to any disclaimer, the term of this patent is extended or adjusted under 35 U.S.C. 154(b) by 0 days.

(21) Appl. No.: 10/206,222

(22) Filed: Jul. 29, 2002

(51) Int. Cl.[7] ..... A47K 13/10
(52) U.S. Cl. ..... 4/246.2
(58) Field of Search ..... 4/234, 237, 246.1, 4/246.2

(56) References Cited

U.S. PATENT DOCUMENTS 5,138,724 A * 8/1992 Chien et al. ..... 4/241
5,414,876 A * 5/1995 Pan ..... 4/246.1
5,435,017 A * 7/1995 Pan ..... 4/246.2
5,461,734 A * 10/1995 Faircloth ..... 4/246.1
6,470,502 B2 * 10/2002 Lu ..... 4/246.1

* cited by examiner

*Primary Examiner*—Charles E. Phillips
(74) *Attorney, Agent, or Firm*—Leong C. Lei

(57) ABSTRACT

An improved structure of a self-lifting toilet seat is disclosed and the seat includes a toilet seat lid, a seat having two lateral sides being mounted onto a cavity at the near rear section thereof and the rear end thereof being connected to a securing seat, two liquid boxes provided with partitioning board within the box so as to isolate a plurality of slots to contain liquid and the slots being intercommunicated and the securing seat being connected to an adjustable sliding seat for the securing of toilet bowl of various sizes, characterized in that the front section of the liquid box is installed at the cavity of the toilet seat and the front section is protruded to form a securing board, by means of a securing element to pivotally mount at the pivotal hole of the cavity so that the front of the liquid box is formed into an actuating pivot.

3 Claims, 8 Drawing Sheets

STRUCTURE OF A SELF-LIFTING TOILET SEAT

BACKGROUND OF THE INVENTION (a) Technical Field of the Invention

The present invention relates to an improved structure of a self-lifting toilet seat and in particular, a toilet seat which can smoothly self-lift after the seat has been used by a user.

(b) Description of the Prior Art

Taiwanese patent publication number 096211 related to a self-timing self-lifting toilet seat and Taiwanese patent publication no. 276480 relates to an improved structure of a self-lifting toilet seat. These conventional seats have drawbacks in that the toilet seat after use is self-lifted but in a position which protrudes from the water tank and the angle thereof cannot be adjusted. If the water tank is too large, these toilet seats cannot be used, and due to the moving of the liquid the self-lifting of the seat is not smooth and may sometimes jam and it stops lifting; thirdly when the seat is at 45 degrees a resisting force is formed to stop the toilet seat from moving upward. Fourth, when the seat is at 90 degrees, due to lacking a partition between the slot at the front section and the slot at the rear section, the water or liquid at the rear of the slot cannot precisely flow to the front section of the slot and so reverse flow of the liquid will occur and this will affect the self-lifting of the seat.

Accordingly, a main object of the present invention is to provide an improved structure of a self-lifting toilet seat, which overcomes the above-mentioned drawbacks.

SUMMARY OF THE INVENTION

The present invention relates to an improved structure of a self-lifting toilet seat which can smoothly self-lift after the seat has been used by a user.

Accordingly, it is an object of the present to provide an improved structure of a self-lifting toilet seat comprising a toilet seat lid, a seat having two lateral sides being mounted onto a cavity at the near rear section thereof and the rear end thereof being connected to a securing seat, two liquid boxes provided with partitioning board within the box so as to isolate a plurality of slots to contain liquid and the slots being intercommunicated and the securing seat being connected to an adjustable sliding seat for the securing of toilet bowl of various sizes, characterized in that the front section of the liquid box is installed at the cavity of the toilet seat and the front section is protruded to form a securing board, by means of a securing element to pivotally mount at the pivotal hole of the cavity so that the front of the liquid box is formed into an actuating pivot.

Another object of the present invention is to provide an improved structure of a self-lifting toilet seat, wherein the seat is lifted up smoothly and the liquid box is provided with a heavy block and an adjusting device to precisely adjust the weight of the liquid box such that the toilet seat cannot self-lift smoothly.

Yet another object of the present invention is to provide an improved structure of a self-lifting toilet seat, wherein a branch slot is provided at an appropriate position at the liquid box such that when the seat is lifted to a fixed position, a portion of the liquid flows into another slot so as to overcome the resisting point and allows the seat to be self-lifted smoothly.

A further object of the present invention is to provide an improved structure of a self-lifting toilet seat, such that when the toilet seat is lifted to the angle of 90 degrees water or liquid at the slot will precisely flow to the slot at the front section, thus a reverse flow of liquid will not occur and the self-lifting of toilet seat will be accurate.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
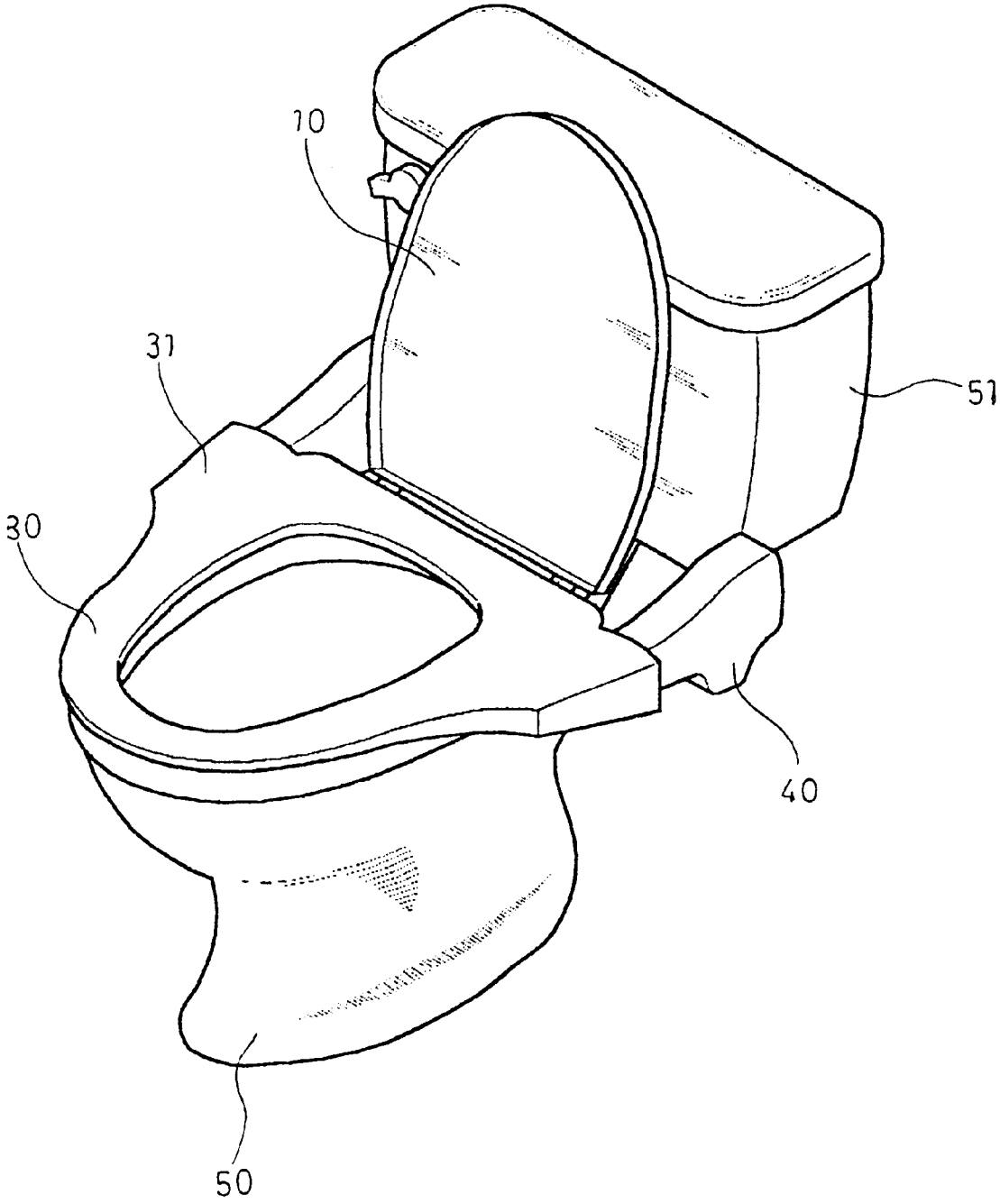
FIG. 1 is a perspective view of the present invention.
Figure 2:
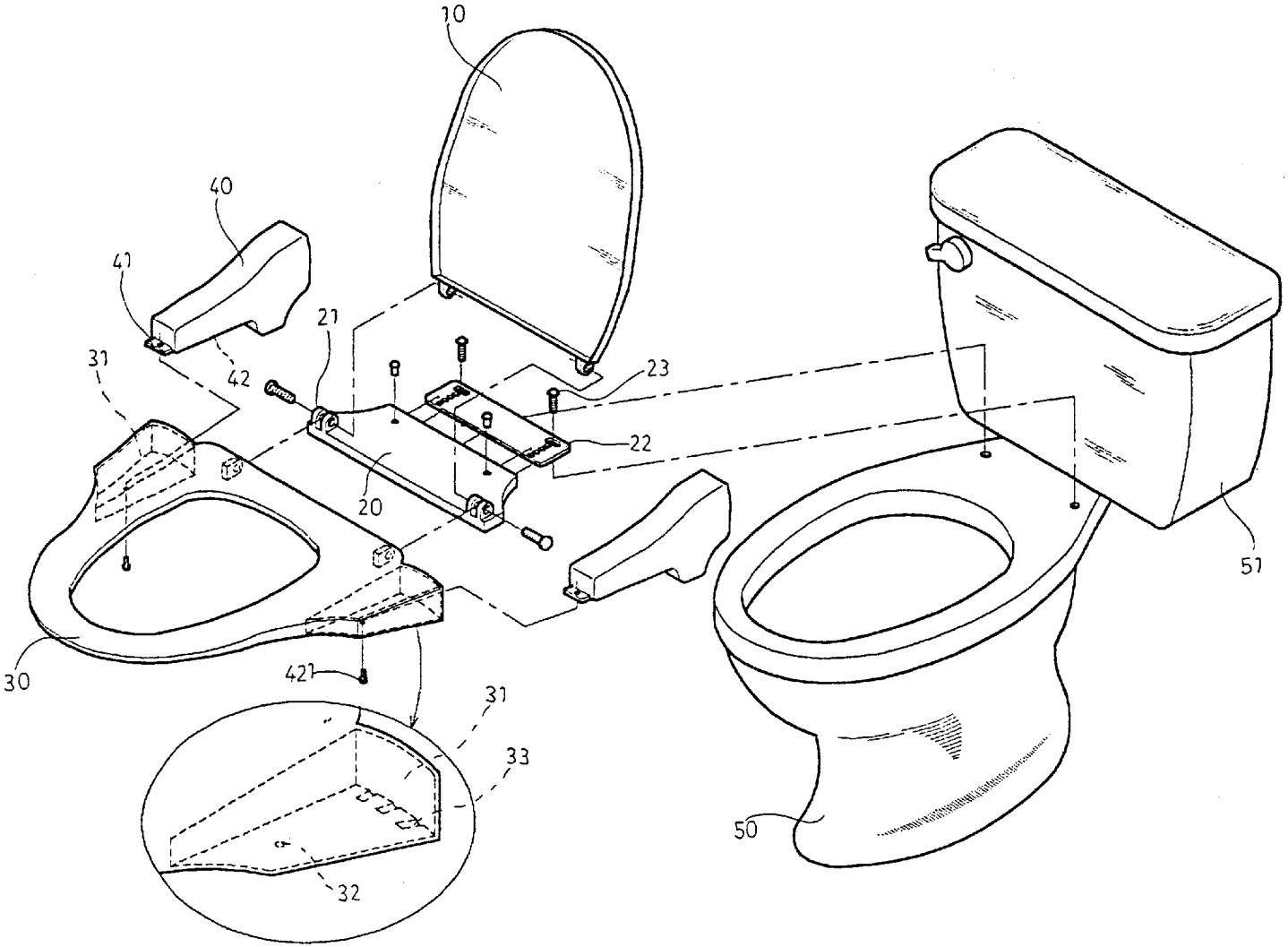
FIG. 2 is a perspective exploded view of the present invention.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1 to 4, there is shown an improved structure of a self-lifting toilet seat comprising a toilet seat lid mounted at a protruded member 21 on a securing seat 20 and a seat 30 having two lateral sides forming into a cavity 31 close to the rear section thereof, and the cavity 31 being provided with an opening at the rear section for the installation of a liquid box 40 and the rear section of the seat 30 being connected to the securing seat 20; and two liquid boxes 40 having the interior containing liquid such as water and the volume being smaller than the cavity 31, and the front section is protruded to form a securing board 41 so that a securing element 421 is pivotally connected to the pivot hole 32 within the cavity 31 and the liquid box 40 in the cavity 31 is moveable and adjustable, and the bottom edge of the liquid box 40 is provided with a protrusion 42 which is engageable with a plurality of recessed points 33 on the cavity 31 to form into a fixed position, and the securing seat 20 being connected to an adjustable sliding seat 22.

The securing element 23 is inserted to the sliding seat 22 such that the entire seat can be mounted onto different sizes and types of the toilet bowl 50 and after the toilet seat is used, the seat 30 is self-lifted up smoothly and quietly.

Figure 5:
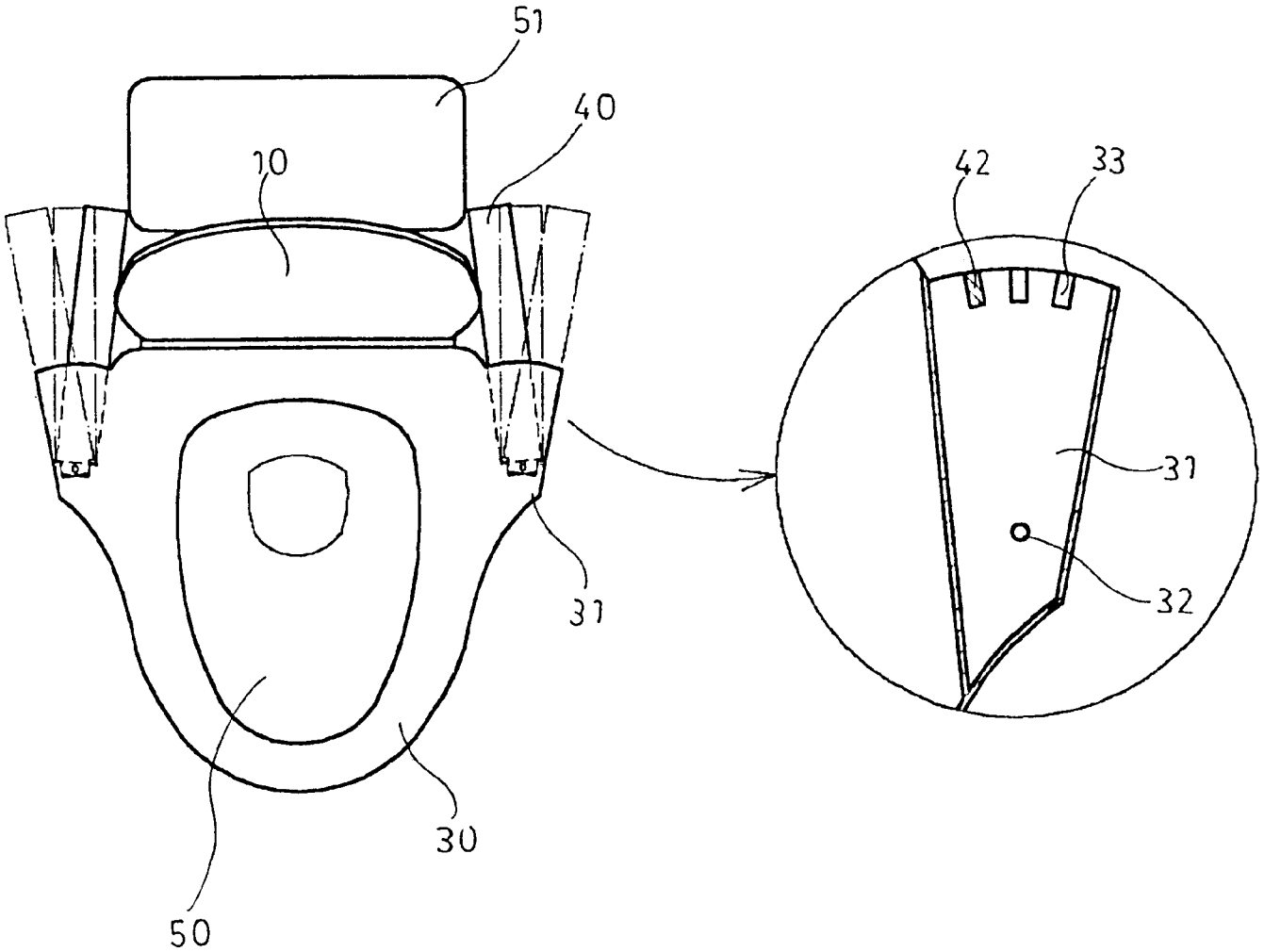
FIG. 5 is a schematic view of the liquid channel which can be adjusted with respect to its angle in accordance with the present invention.

Referring to FIG. 5, the liquid box 40 can be mounted within the cavity 31 and move horizontally to adapt to the size and width of the water tank 51 of the toilet bowl. The protruded point 42 at the bottom edge of the liquid box 40 can be engaged with the recessed point 33 of the cavity 31.

Figure 3:
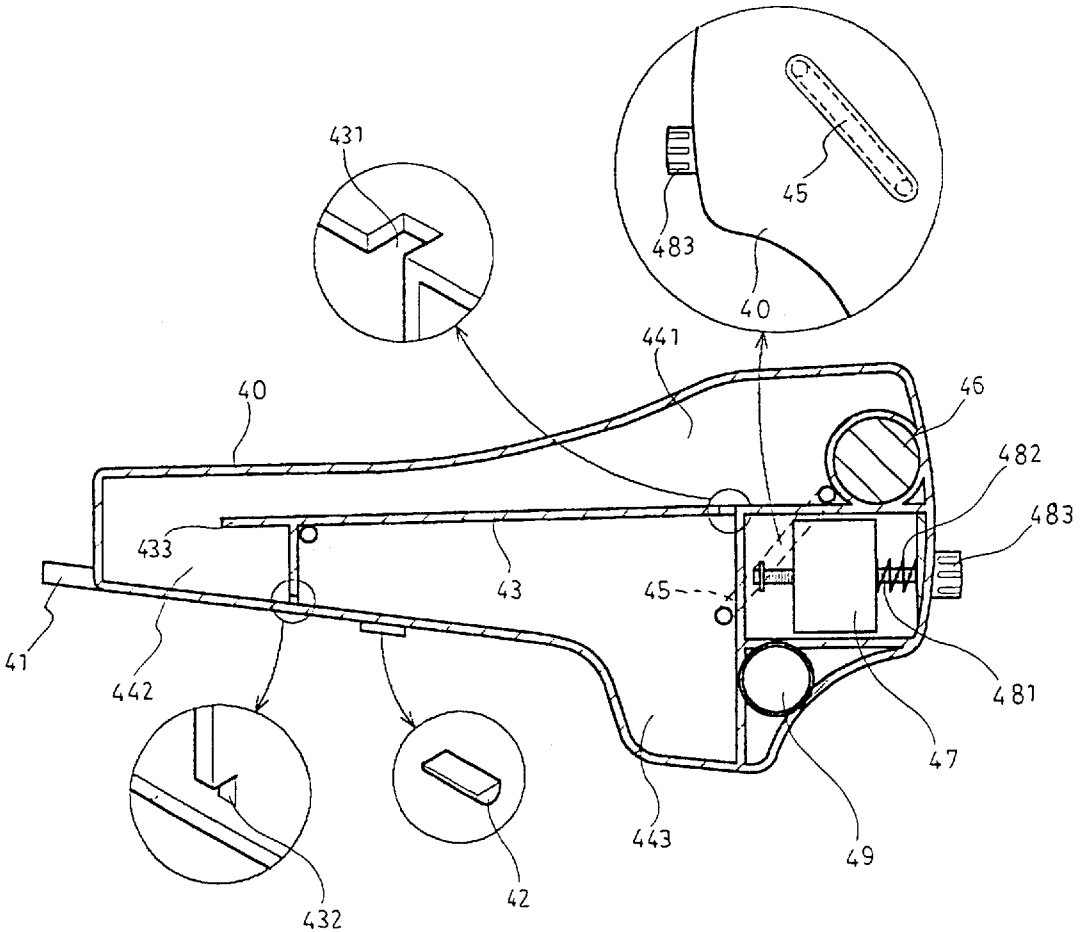
FIG. 3 is a sectional view of the liquid box with adjustable heavy block in accordance with the present invention.
Figure 4:
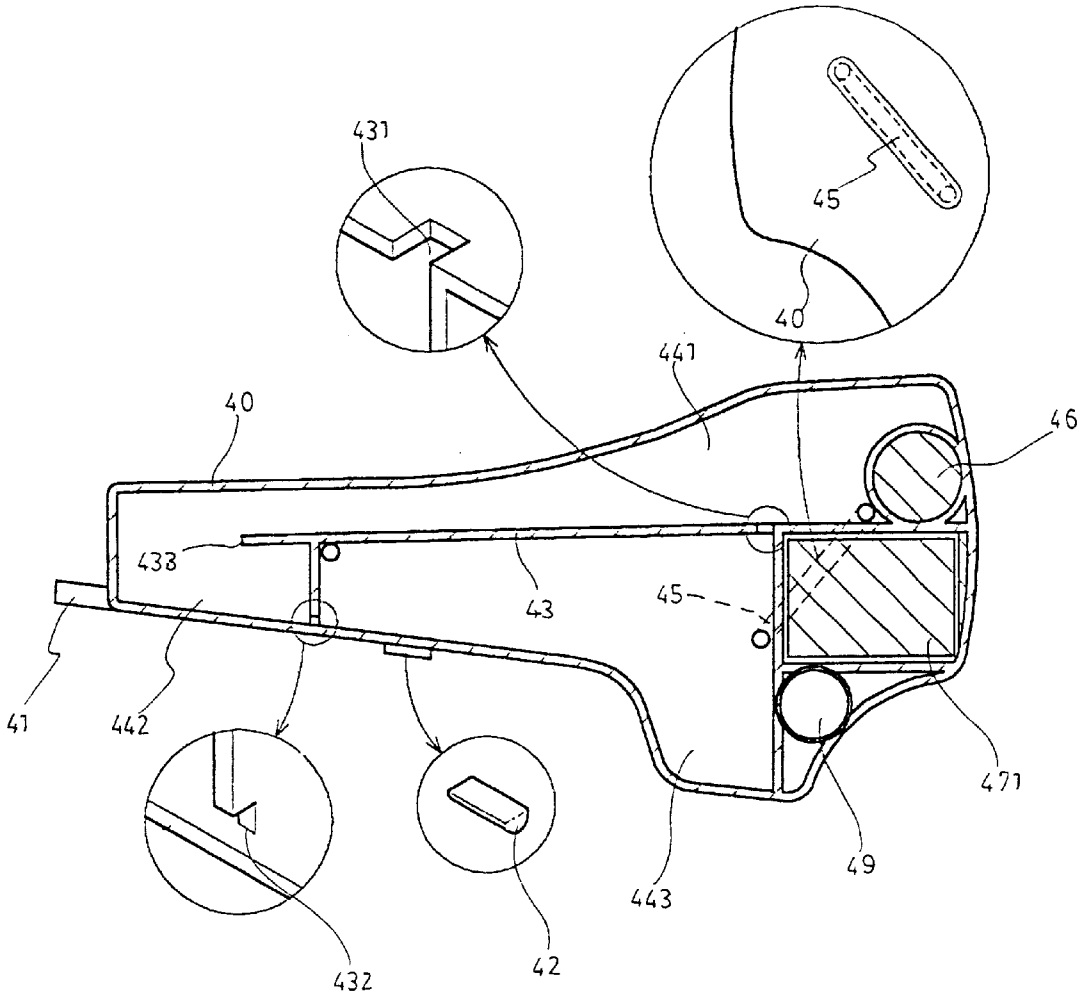
FIG. 4 is a sectional view of the liquid box without an adjustable heavy block in accordance with the present invention.

Referring to FIGS. 3 and 4, the interior of the liquid box 40 is divided into a first slot 441, a second slot 442, and a third slot 443 by means of a partitioning board 43, wherein the first slot 441 and the second slot 442 are interconnected and notches 431,432 formed at the connection of the wall of the box body and the third slot 443 are connected to the first slot 441 and the second slot 442 by means of the partitioning board 43 such that liquid flows freely between the individual slots and the surface of the liquid box 40 between the first slot 441 and the third slot 443 is connected to a side slot 45 such that the liquid can flow between the first slot 441 and the third slot 443 so as to overcome the resisting force when the seat 30 is at 45 degree. The rear section of the box 40 is provided with slot to place heavy block 46 or adjustable heavy block 47. The heavy block 47 employs an adjustable device to adjust the position thereof, and a screw rod 481 of the adjusting device is mounted with a heavy block 47 and an elastic member 482 is provided to the screw rod 481. The rear side surface of the liquid box 40 is provided with an adjusting button 483 facilitating the rotating of screw rod 481. Thus the upper and the lower part of the heavy block 47 is a planar surface and by means of the adjusting button 483, the heavy block 47 moves smoothly and precisely adjusting the weight distribution of the liquid box 40. The liquid box 40 is also provided with channel 49 for mounting of heavy block if it is needed.

Figure 6A:
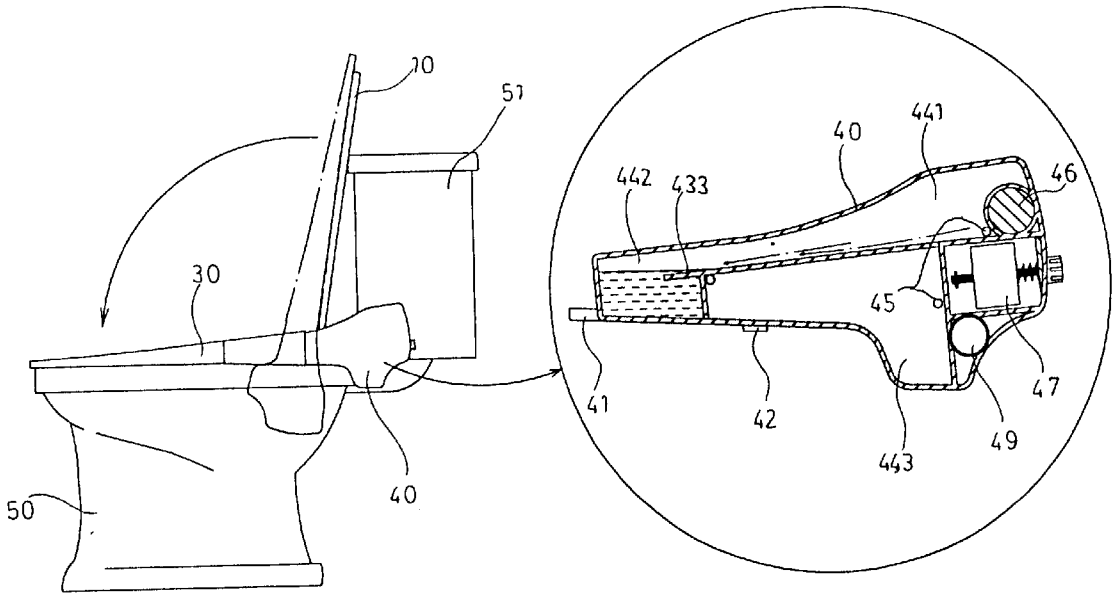
FIGS. 6A, 6B, 7A, 7B, 8A and 8B are schematic views showing the delayed self-lifting of the toilet seat in accordance with the present invention.
Figure 6B:
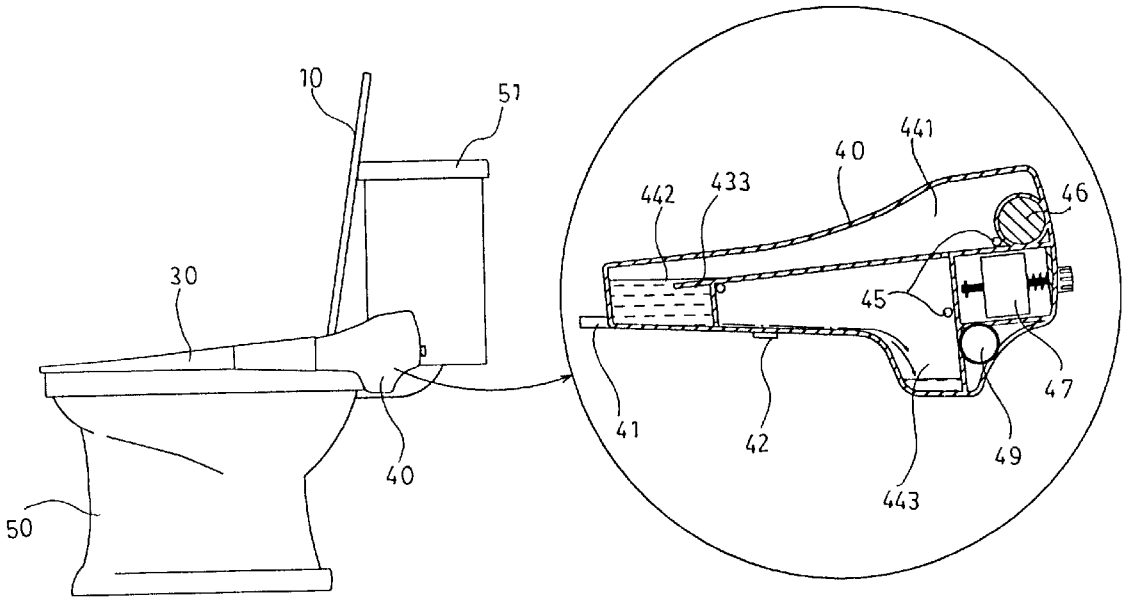
Figure 7A:
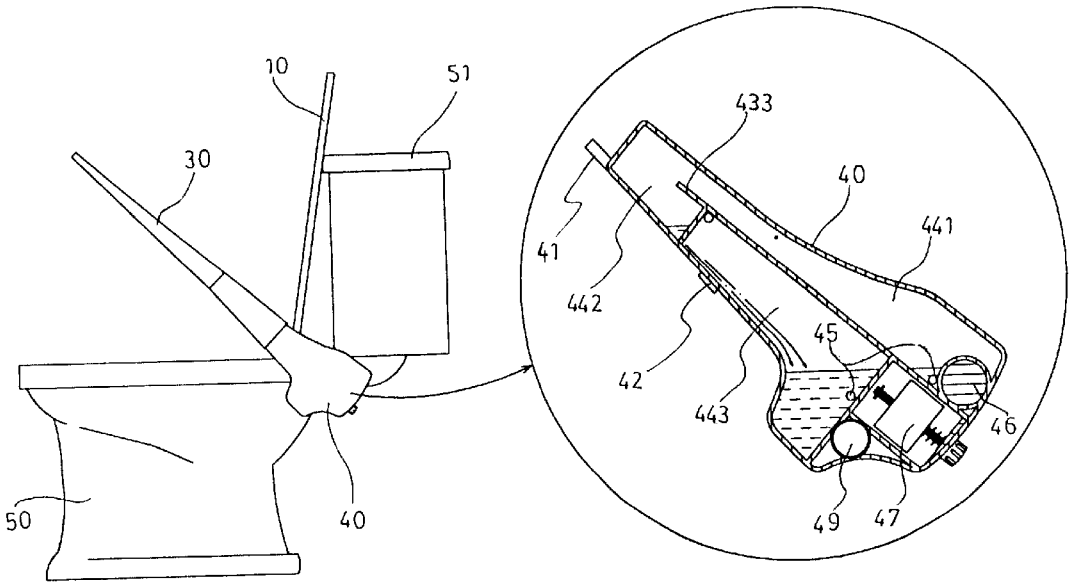
Figure 7B:
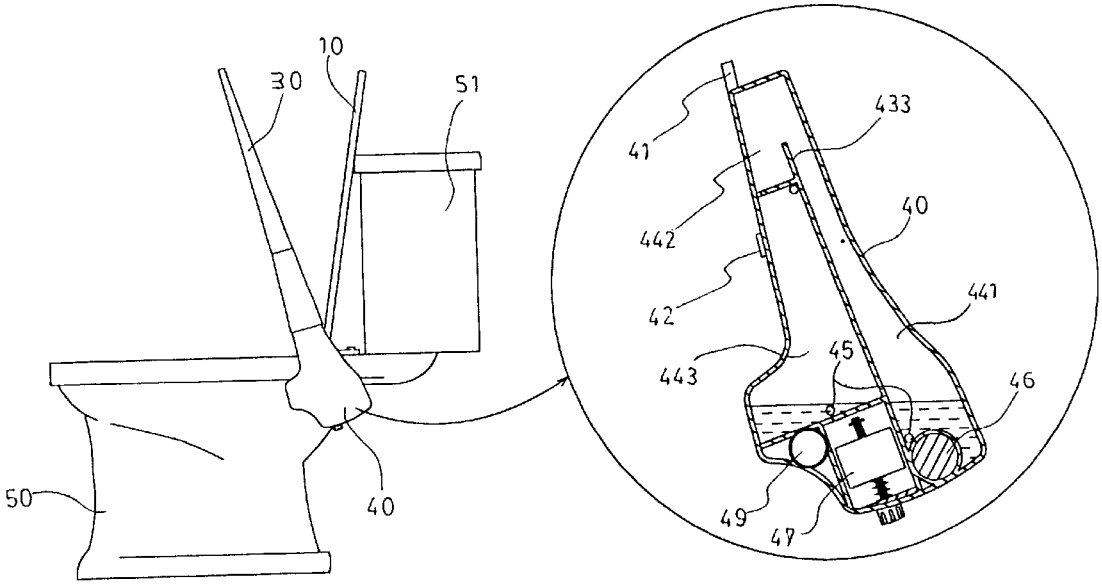
Figure 8A:
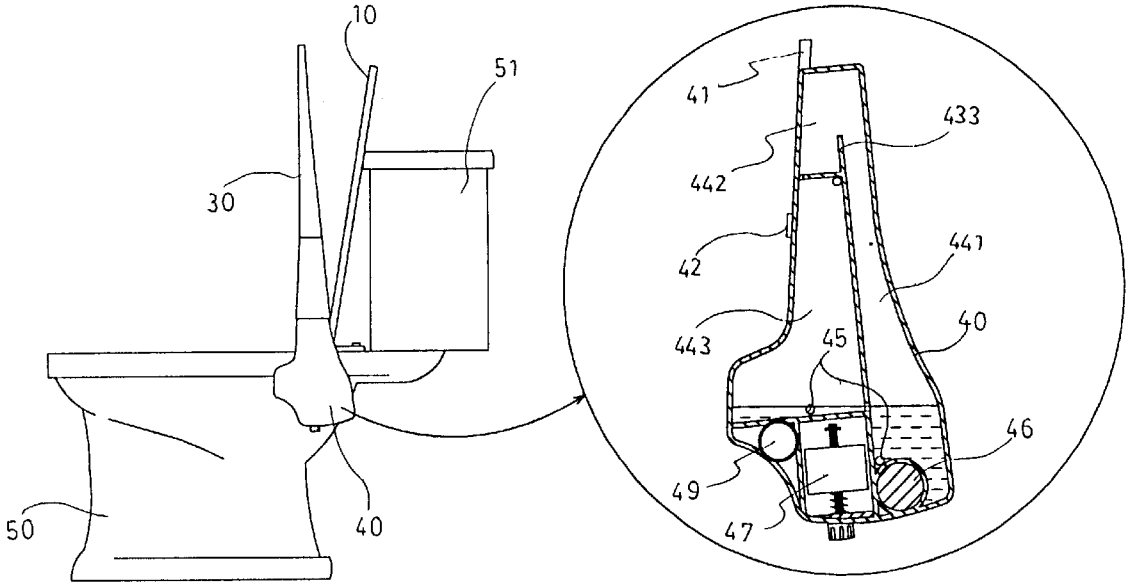
Figure 8B:
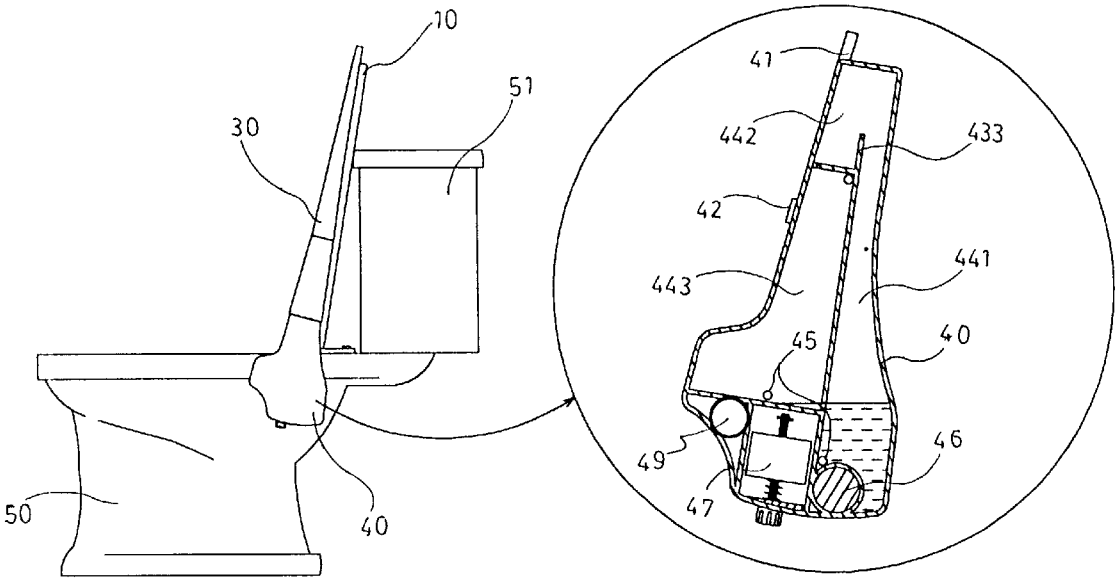

As shown in FIG. 6*a*, when using the seat 30, the seat 30 is moved downward to the toilet bowl 50 and the liquid in the liquid box 40 flows from one slot 441 to the second slot 442. Between the first slot 441 and the second slot 442, a protruded board 433 is provided such that the liquid at the rear section of the first slot 441 can accurately move the front section of the second slot 442 so as to avoid the liquid flowing in reverse and therefore the seat 30 can be self-lifted smoothly, Referring to FIG. b, if the toilet seat 30 cannot be self-lifted as a result of the weight of the user, the liquid will flow through the notch 432 to the third slot 443 so that the first stage balance is obtained. As shown in FIG. 7*c*, when the toilet seat 30 has been used and the user moves away from the toilet seat, the liquid will flow to the third slot 443 and the toilet seat 30 will be self-lifted smoothly. As shown in FIG. 7*d*, when the seat 30 is positioned at a certain angle, the liquid at the third slot 443 will flow throughout the notch 431 to the rear of the first slot 441 so as to overcome the resisting point when the seat is lifted. Referring to FIGS. 8*e* and 8*f*, when the liquid in the third slot 443 flows slowly into the first slot 441, the seat 30 will complete the self-lifting action.

In accordance with the present invention, when the lifting of the toilet seat 30 is not smooth, the adjusting button 483 can be adjusted so that the weight distribution of the liquid box is precisely adjusted.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An improved structure of a self-lifting toilet seat, said seat having two lateral sides with a cavity opening rearwardly at the near rear section of each side and the rear end thereof being connected to a securing seat for pivotal movement thereabout, two liquid boxes provided with a partitioning board within each box so as to isolate a plurality of slots to contain liquid and the slots being intercommunicated and the securing seat being connected to an adjustable sliding seat for accommodating toilet bowls of various sizes, characterized in that a front section of each liquid box is installed in each cavity of the toilet seat and the front section of each box carries a protrusion which forms a securing board which is pivotally attached in each cavity by means of a securing element to pivotally mount at the pivotal hole of the cavity so that the front of the liquid box is formed into an actuating pivot.

2. The toilet seat of claim 1, wherein the liquid box is provided with slots for the mounting of a fixed heavy block or an adjustable heavy block.

3. The toilet seat of claim 2, wherein the adjustable heavy block employs an adjustable device to adjust the position of the block, the adjustable device uses a screw rod to mount the heavy block and the screw rod is mounted with an elastic element, and the rear side surface of the liquid box is provided with an adjustable button, thereby the adjusting of the button will precisely adjust the weight of the liquid box.

* * * * *